US005850766A

United States Patent [19]

Stokes

[11] Patent Number: 5,850,766

[45] Date of Patent: Dec. 22, 1998

[54] PIPE JOINT BREAK-OUT DEVICE

[76] Inventor: Charles William Stokes, 647 Ellis St., Mt. Pleasant, S.C. 29464

[21] Appl. No.: 857,877

[22] Filed: May 16, 1997

[51] Int. Cl.[6] ..... B25B 13/50

[52] U.S. Cl. ..... 81/57.34; 166/77.5

[58] Field of Search ..... 81/57.33, 57.34; 166/77.5, 78, 85; 175/170, 171

[56] References Cited

U.S. PATENT DOCUMENTS

| | | | |
|---|---|---|---|
| 3,239,016 | 3/1966 | Alexander . | |
| 3,902,385 | 9/1975 | Haby . | |
| 3,913,687 | 10/1975 | Gyongyosi et al. | 175/85 |
| 3,942,592 | 3/1976 | Hodge . | |
| 3,985,189 | 10/1976 | Jahnke et al. . | |
| 4,030,542 | 6/1977 | Poe et al. . | |
| 4,037,672 | 7/1977 | Hodge . | |
| 4,258,796 | 3/1981 | Horning et al. . | |
| 4,309,922 | 1/1982 | Beckley et al. . | |
| 4,345,493 | 8/1982 | Rassieur . | |
| 4,381,685 | 5/1983 | Brooks . | |
| 4,403,666 | 9/1983 | Willis . | |
| 4,407,629 | 10/1983 | Willis . | |
| 4,442,907 | 4/1984 | Sexton . | |
| 4,658,915 | 4/1987 | Goris et al. . | |
| 4,667,752 | 5/1987 | Berry et al. . | |
| 4,671,365 | 6/1987 | Back et al. | 173/28 |
| 4,762,187 | 8/1988 | Haney | 175/171 |
| 4,800,968 | 1/1989 | Shaw et al. . | |
| 4,821,814 | 4/1989 | Willis et al. . | |
| 4,844,171 | 7/1989 | Russell, Jr. . | |
| 4,867,236 | 9/1989 | Haney et al. . | |
| 5,036,927 | 8/1991 | Willis . | |
| 5,297,833 | 3/1994 | Willis et al. . | |
| 5,388,647 | 2/1995 | McGlothlin . | |
| 5,388,651 | 2/1995 | Berry | 175/85 |

*Primary Examiner*—James G. Smith

*Attorney, Agent, or Firm*—Harleston Law Firm; Kathleen M. Harleston

[57] ABSTRACT

A device for rotating a length of pipe to make or break a pipe joint is provided. The device is adapted at its upper end to be connected to a top head drive drilling machine, and at its lower end to be connected to the first threaded pipe in a drill string. The device comprises a central shank, a movable arm and a gripping assembly. The movable arm is hinged to and extends about the central shank, and can move to an open or a closed position with the movement of the device. The gripping assembly is mounted on the movable arm and is adapted to contact the first threaded pipe when the movable arm is in the closed position. The device is rotated by means of the top head drive, causing the pipe joint between the first two threaded pipes in the drill string to be broken. The movable arm then swings open and the first threaded pipe can be disconnected from the device.

12 Claims, 4 Drawing Sheets

PIPE JOINT BREAK-OUT DEVICE

BACKGROUND OF THE INVENTION

1. Technical Field

The present invention relates to a pipe joint break-out device, more particularly a device or tool for breaking joints between drill rods, or for making drill rods.

2. Background

Different lengths and diameters of pipe are used to drill wells in the ground for oil, water, or gas, or geothermal heat pump holes. In drilling a well, lengths of pipe, or drill rods, are "made", or connected together via threaded joints to form a drill string. As the well is drilled deeper, drill rod sections are connected one at a time to the uppermost pipe in the drill string.

Once a well has been drilled, the drill string is raised, usually by means of a commercially available drilling machine, and drawn from the well bore in increments. The drill rod sections are then removed one at a time by breaking the joints between the rods. To do this, the length of drill string still extending into the well can be held somewhat stationary using clamp jaws, slips, or the equivalent while the uppermost section of drill rod is broken and unthreaded in a counterclockwise direction using the top head drive of the drilling machine. The unthreaded pipe can then be handled manually or by other means.

It is difficult, exhausting work to make and break pipe joints manually. A typical day for a driller of geothermal heat pump holes, for example, can include breaking a hundred or more drill rods. Various tools and devices have been developed to assist in making and breaking drill rods, but these significantly differ from the present invention. The present device is connected to the top head drive of a drilling machine at one end of the device, and to the first threaded pipe joint of a drilling string at the other end. This invention provides a relatively simple, fast, efficient, and inexpensive means of making and breaking drill rods.

SUMMARY OF THE INVENTION

The present device is for effecting relative rotation between two threaded pipes about an axis of those pipes, and comprises: a) a central shank having two opposite ends, and being adapted at one end for connection to a top head drive of a drilling machine and at the other end for connection to an opposite end of a first of the threaded pipes; b) a movable arm or arms, being adapted to extend about the shank, and being connected to the shank via a first hinge connection; and c) a gripping assembly being attached to the arm and being adapted to contact the first threaded pipe.

BRIEF DESCRIPTION OF THE DRAWINGS

A more complete understanding of the invention and its advantages will be apparent from the following Description of the Preferred Embodiment(s) taken in conjunction with the accompanying drawings, wherein.

DESCRIPTION OF THE PREFERRED EMBODIMENTS

Figure 1:
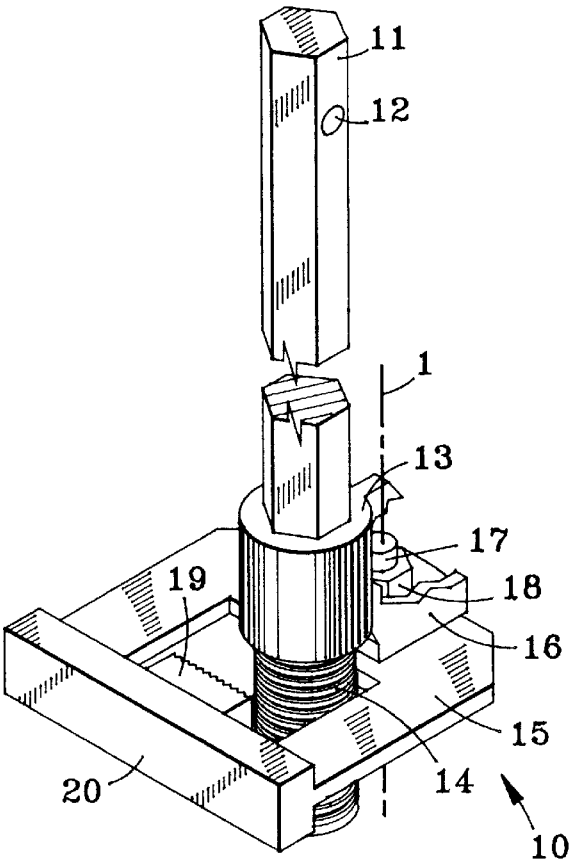
FIG. 1 shows a perspective view of a pipe joint break-out device constructed in accordance with the present invention.

Referring to the drawings, the invention will now be described in more detail. FIG. 1 shows one illustrative embodiment of a pipe joint break-out device constructed in accordance with the present invention. The device is generally designated by the reference character 10. The device 10 centers around a shank 11 having two opposite ends. The upper portion of the shank 11 is adapted for the connection of the device 10 to a drilling rig, not shown, which includes a top head drive. This preferred embodiment contains a hole 12 in the shank 11 through which a locking pin can be placed after the device 10 is connected to the top head drive. The shank 11 in this preferred embodiment is a hex rod.

The lower portion of shank 11 is adapted for connection to an opposite end of a first of the threaded pipes in the drill string to be broken. This lower part comprises an arm (or arms), which is adapted to extend about the shank 11, and a gripping assembly. The arm (or arms) is connected to the shank 11 via a hinge connection. The gripping assembly is attached to the arm and adapted to contact the first threaded pipe in the drill string. In FIG. 1, a collar 13 surrounds the lower part of the shank 11 and is affixed to a stationary arm 16. Stationary arm 16, which is shown cut away in FIG. 1, is movably affixed to a movable arm 15 via a hinge connection. The hinge connection is comprised of nut 17 and bolt 18. The movable arm 15 pivots at the centerpoint of the hinge connection, which is shown at line 1. The movable arm 15 extends about the shank 11. A gripping assembly is attached to the movable arm 15. In FIG. 1, the gripping assembly is a set of serrated teeth 19 which is affixed to a bar 20, which is a part of the movable arm 15, approximately opposite to the hinge connection. At the bottom of the shank 11 is a male threaded end 14, which is adapted to fit into the female threaded end of the first pipe in the drill string. The male threaded end 14 preferably has three or four threads to the inch, most preferably four threads to the inch, and is most preferably not tapered.

Figure 2:
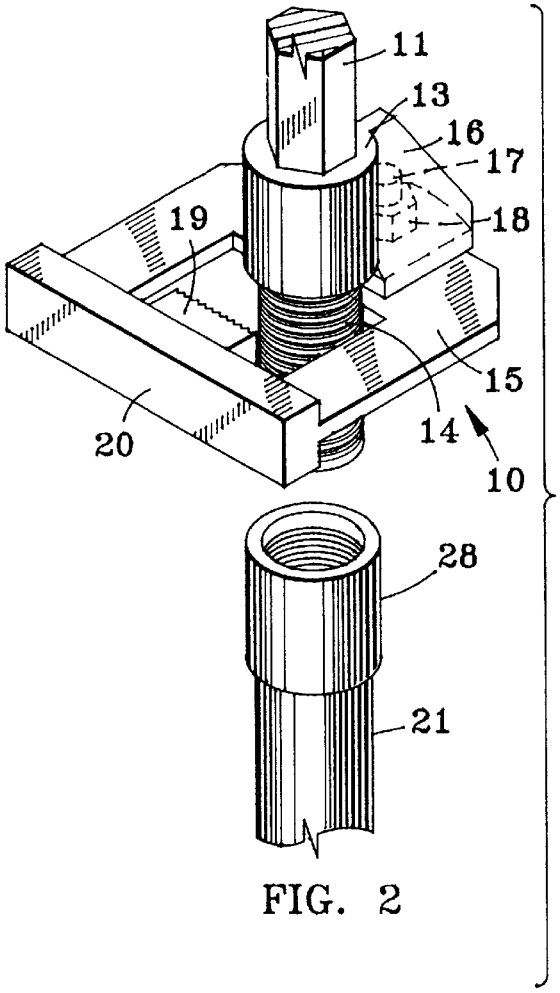
FIG. 2 shows a perspective view of the lower portion of the pipe joint break-out device of the present invention, which is shown just prior to connection to a length of threaded pipe.

FIG. 2 shows the lower portion of the device 10 just prior to the connection of the device to the first threaded pipe 21 of the drill string. The device 10 has been lowered into place over the first threaded pipe 21 using the top head drive (not shown). The first threaded pipe 21 ends in a collar 28. The set of serrated teeth 19 is positioned on the movable arm 15 at a point opposite to the hinge connection. The hinge connection is at nut 17 and bolt 18.

Figure 3:
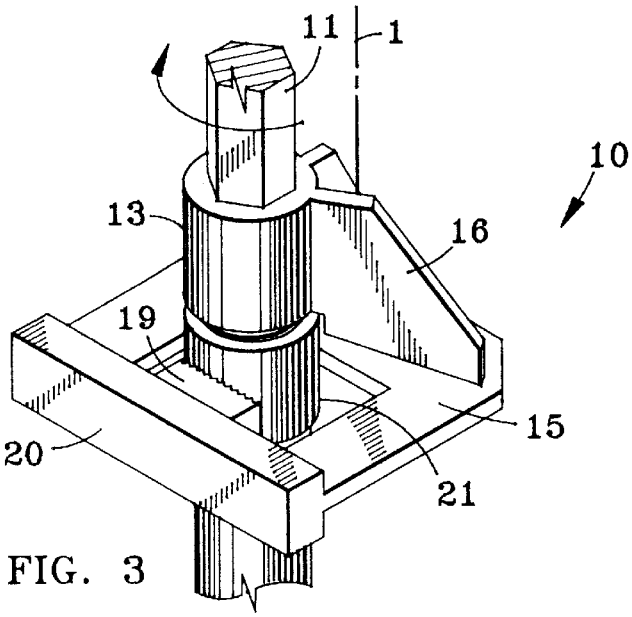
FIG. 3 shows a perspective view of a pipe joint break-out device constructed in accordance with the present invention, which is shown engaged with a length of threaded pipe from a drill string, and which illustrates the gripping assembly in engagement with the length of threaded pipe.

In FIG. 3, the device of the present invention is shown coupled with the uppermost length of threaded pipe 21 from a drill string. To accomplish this, the device 10 is rotated clockwise by the operator, using the top head drive, to screw the male threaded end 14 of the device 10 into the female end of the first threaded pipe 11. In FIG. 3, the movable arm 15 is in a "closed" position; the serrated teeth 19 are in contact with the first threaded pipe 11. The center point of the pivot is shown at line 1, which goes through the hinge connection behind stationary arm 16. The device 10 is now connected to the first threaded pipe 21 and is in position for the next step, which is the breaking of the pipe joints between the first threaded pipe 21 and the second threaded pipe, not shown. The second threaded pipe extends down into the well bore below the first threaded pipe 21.

Figure 4A:
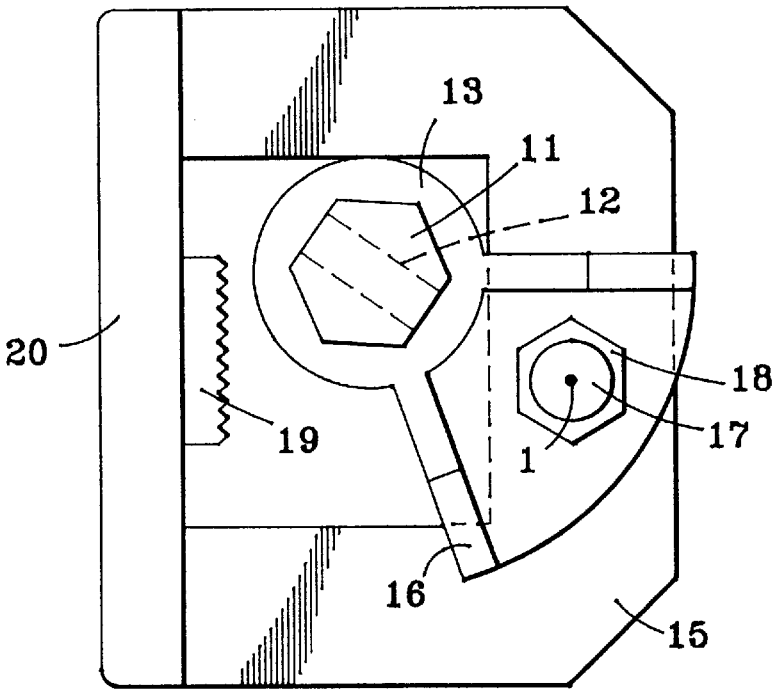
FIGS. 4 A and B show a top plan view of the pipe joint break-out device of FIG. 1 and illustrates a gripping assembly which is not engaged in FIG. 4 A, and is engaged in FIG. 4 B.
Figure 4B:
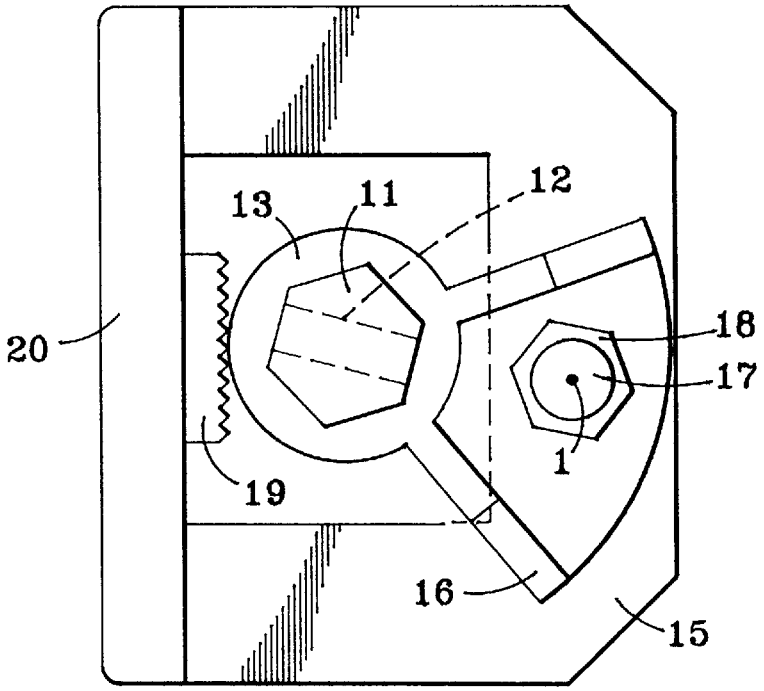

FIGS. 4 A and B show the device 10 from a top plan view. The device 10 is attached to the first threaded pipe 21 of the drill string. The movable arm 15 pivots at the center point 1 of the hinge connection, which includes bolt 17 and nut 18. In FIG. 4 A, the movable arm 15 is in the "open" position, so that the serrated teeth 19 are not engaged or in contact with the first threaded pipe 21. In FIG. 4 B, the movable arm 15 is shown in the "closed" position, where the serrated teeth 19 are in contact with the first threaded pipe 21. The device 10 is thus in an engaged position.

Figure 5:
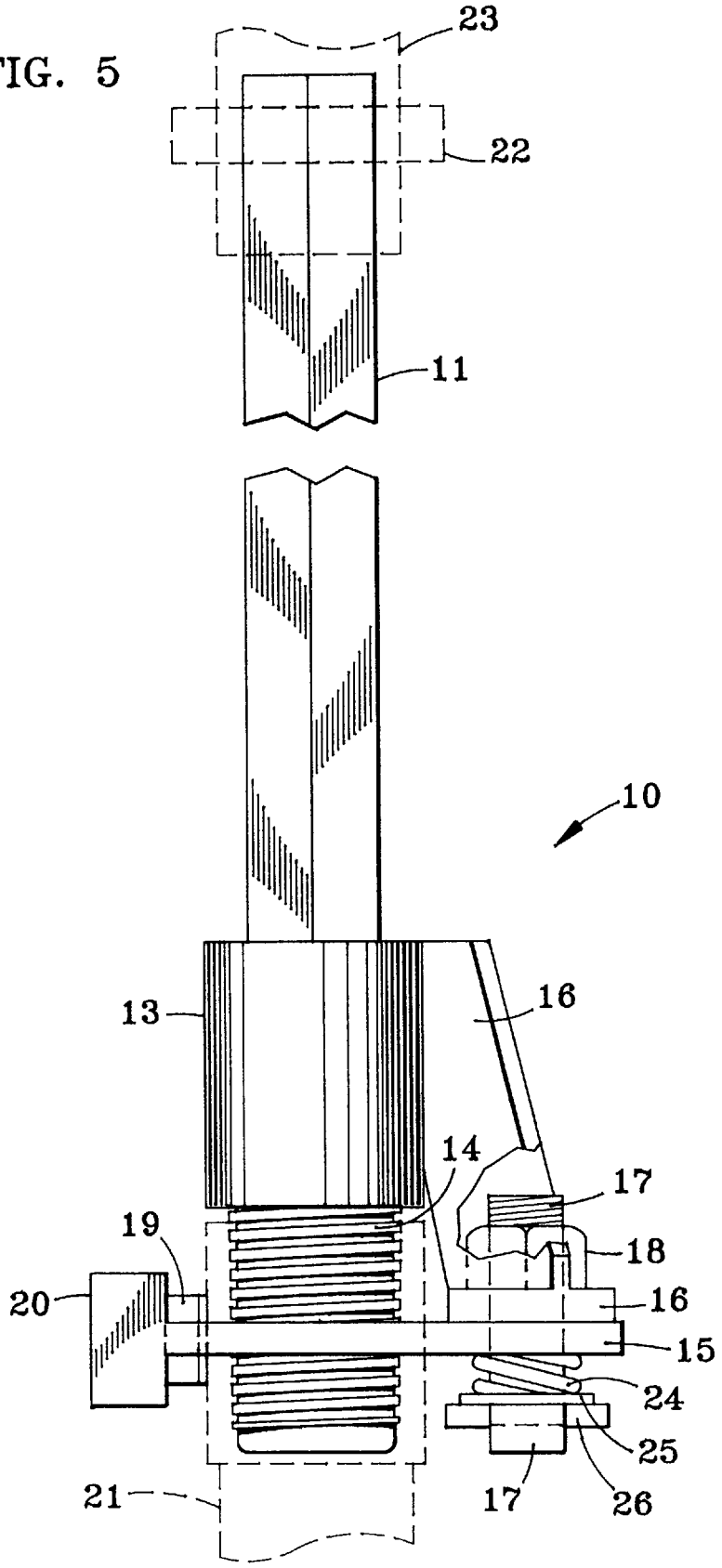
FIG. 5 shows a lateral view of the pipe joint break-out device shown in FIG. 4 B, which has been rotated approximately ninety degrees, and illustrates the gripping assembly engaged with a length of threaded pipe from the drill string.

FIG. 5 shows a lateral view of the device 10 of FIG. 4 B, which has been rotated approximately ninety degrees. Referring to the lower portion of the pipe joint break-out device 10 in FIG. 5, the movable arm 15 is in the "closed" position, so that the serrated teeth 19 are in contact with the first threaded pipe 21 from the drill string. The collar 13 of the device 10 is attached to the shank 11. Attached to the collar 13 is a stationary arm 16. Movable arm 15 is movably attached to stationary arm 16 via the hinge connection, which includes bolt 17 and nut 18. The movable arm 15 rotates about a pivot point through the center of bolt 17 just below the stationary arm 16. Bolt 17 is partially threaded in order to accept nut 18 and is tightened against the movable arm 15, yet it is loose enough to allow movement of the movable arm 15. Below the point where movable arm 15 attaches to bolt 17 is a nonthreaded portion of bolt 17. A short bolt spring 24 is coiled around this bottom portion of bolt 17. Pushing against this bolt spring 24 is a washer 15, and below that is a relatively small bolt locking pin 26.

Referring to the upper portion of the device 10 in FIG. 5, the device 10 is adapted to be used in conjunction with a top head drive drilling rig, not shown, which includes a top drive head, indicated generally at 23. The top drive head 23 is connected to the upper portion of the device 10 by means of a locking pin 22 , which is inserted through hole 12 in the shank 11 of the device 10. The device 10 is thus suspended from the drive head.

The device 10 is not held rigidly in place; this attachment allows for easy movement of the device 10. The top head drive 23 may be moved vertically in a controlled fashion to raise and lower the device 10. The torque applied by drive head 13 is hydraulically controlled by the operator of the top head drive drilling rig in a conventional manner. Ordinarily, the top head drive drilling rig is maneuvered close to the well, and the operator is standing by the device of the present invention during its operation at the well.

Figure 6:
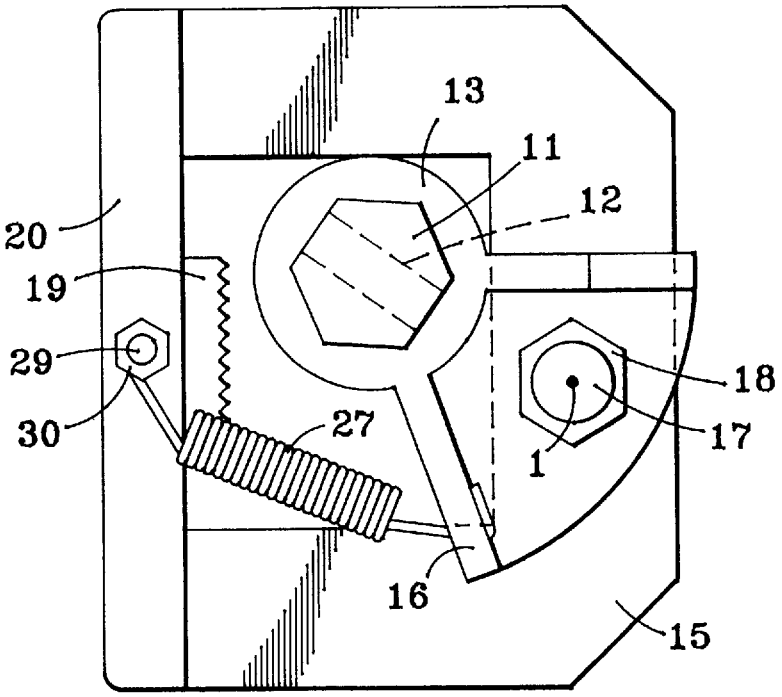
FIG. 6 shows a top plan view of another embodiment of a pipe joint break-out device which is constructed in accordance with the present invention, and which has a spring member.

FIG. 6 shows a top plan view of another embodiment of a pipe joint break-out device 10. This view is analogous to the view of FIG. 4 B except that this preferred embodiment also has a spring member 27. Spring member 27 is suspended between stationary arm 16 and the bar 20 portion of movable arm 15. The end of spring member 27 is attached to arm bar 20 by means of a relatively small nut 29 and bolt 30. The device is shown attached to the first threaded pipe 21 of the drill string. The movable arm 15 pivots at the center point of the hinge connection, which includes bolt 17 and nut 18. Bolt 17 and nut 18 are larger than nut 29 and bolt 30, which are merely used to tie down the spring member 27. The movable arm 15 is shown in the "open" position in FIG. 6, so that the serrated teeth 19 are not in contact with the first threaded pipe 21. The spring member 27 holds the device 10 in the "open" position. Counterclockwise motion swings the movable arm 15 and overcomes the tautness of the spring so as to engage, or close, the device 10.

To break a pipe joint using a preferred embodiment of the present invention, the pipe joint break-out device, which is light-weight and portable, is carried to the job site. The present device can also be used for making the string of drill pipes, if desired, but it is preferably used for breaking the drill string. Ordinarily, the well has been drilled and the drill string extends down into the well bore. The operator connects the pipe joint break-out device 10 to the top head drive 23 and inserts a locking pin 22 through hole 12 in the shank 11 of the upper portion of the device, as shown in FIG. 5. The device 10 is now suspended from the top head drive drilling rig and is ready for the second basic step: connection to the first threaded pipe 21 of the drill string.

In the second basic step, the first threaded pipe 21 is held steady over the well bore, which is not shown, using a pipe wrench or other means. The device 10 is maneuvered into position over the first threaded pipe 21 using the top head drive. The device 10 is lowered vertically over the first threaded pipe 21 using the top head drive. The movable arm 15 is in the "open", or disengaged, position.

Next, the device 10 is rotated clockwise by the operator using the top head drive so that the male threaded end 14 of the device 10 is screwed into the female end of the first threaded pipe 21. Counterclockwise motion ordinarily causes the movable arm 15 to swing to the "closed" position, so that the serrated teeth 19 are in contact with the upper portion of the first threaded pipe 21, which is shown in FIGS. 3 and 5. The device 10 is now connected to the first threaded pipe 21 and is in position for the third basic step: breaking the pipe joints between the first threaded pipe 21 and the second threaded pipe, which extends down into the well bore.

If the movable arm 15 has not been snapped into the "closed" position by the stop or start motion of the top head drive, the movable arm 15 can be flicked into the closed position using the operator's hand. The alternate embodiment of the present device 10 with the spring member 27, which is shown in FIG. 6, has a movable arm 15 which snaps quickly into the closed or open position. The movable arm 15 pivots between the open and closed positions. The center point of the pivot is at the first hinge connection, where the stationary arm 16 contacts the movable movable arm 15. The hinge connection preferably comprises bolt 17, nut 18, bolt spring 24, washer 25 and small locking pin 26.

In the third basic step, the pipe joint is broken. The pipe joint break-out device 10, which is now connected to the drill string, is raised vertically using the top head drive, and the second threaded pipe is held steady using a pipe wrench or other means. The pipe joint break-out device 10 is then rotated counterclockwise using the top head drive, causing the joint between the first threaded pipe 21 and the second threaded pipe below it (not shown) to be broken.

The fourth basic step is the removal of the first threaded pipe 21 from the male threaded end 14 of the present device 10. Once the joint is broken, the device 10 and the first threaded pipe 21 are lowered by means of the top head drive until the lower portion of the device is within reach of the operator. The movable arm 15 is ordinarily in the open, or disengaged, position. The first threaded pipe 21 is grasped and held steady by manual or other means while the device 10 is rotated using the top head drive. The male threaded end 14 of the device 10 is thus uncoupled from the female threaded end of the first threaded pipe 21. The relative motion of the first threaded pipe 21 and the serrated teeth 19 when the top head drive 23 is run briefly disengages the serrated teeth 19 from the first threaded pipe 21. If the device 10 has the preferred spring member 27, the spring has just enough tension to keep the device in the open position. Slips and a pipe wrench preferably hold up the second threaded pipe (not shown), so that the drill string is prevented from falling down into the bore hole. The first threaded pipe 21 is removed, and the pipe joint break-out device 10 is ready for use again to break the joints of the remaining drill string, or for use on another drill string at another well. When work is completed, the locking pin 22, as shown in FIG. 6, is removed from hole 12 in the shank 11 of the device 10, and the device 10 is uncoupled from the top head drive 23. The pipe joint break-out device 10 can be taken off-site or left on-site, and it is easily transported between job sites.

In summary, the device 10 comprises a first element: a central shank 11 having two opposite ends, and being adapted at one end for connection to a top head drive 23 of a drilling machine and at the other end for connection to an opposite end of a first threaded pipe 21. The shank 11 preferably has an upper and a lower portion, the lower portion having a male threaded end 14 suitable for close connection to a female end of the first threaded pipe 21. The shank 11 is preferably a straight, solid pipe, most preferably a hex rod. The upper portion of the shank 11 preferably contains a hole 12 which runs perpendicular to the length of the pipe. A removable latching or locking pin 22 is preferably placed through the hole to fasten the device to the top head drive connection. The device 10 can thus easily be attached to or detached from the top head drill rig. However, other means of connection to the top head drive could be employed.

The second element of the present device is a movable arm 15, being adapted to extend about the shank 11, and being connected to the shank 11 via a hinge connection. The hinge connection preferably allows for relative swinging movement of the arm about the shank. Preferably, a stationary arm 16 projecting from the shank 11 is hinged to the movable arm 15 via the hinge connection. Preferably, a spring member 27 further connects the stationary arm 16 to the movable arm 15. Preferably, the spring member 27 is tautly connected at one end to the movable arm 15 at approximately the same point as the serrated teeth 19, and at the other end to the stationary arm 16. A set of movable arms rather than a single movable arm could be employed herein. The movable arm 15 preferably extends about but does not contact the shank 11, and is adapted to alternately swing away from and toward the shank 11.

The hinge connection preferably comprises a nut 18 and bolt 17, more preferably partially threaded bolt inserted through a nut, an extension of the stationary arm 16, an extension of the movable arm 15, and a spring 24. More preferably, a locking pin 26 is inserted through the bottom portion of the bolt so as to exert pressure against the movable arm 15, yet allow it to move.

The third element of the present device is a gripping assembly attached to the movable arm 15 and being adapted to contact the first threaded pipe 21. The gripping assembly is preferably positioned on the movable arm 15 at a point opposite to the first hinge connection. The gripping assembly could comprise one or more gripping mechanisms positioned along the movable arm 15. A variation is a device according to the present invention with two opposite, movable arms connected to the shank via the first hinge connection, each arm having its own gripping means. The gripping assembly is preferably one or more sets of teeth, most preferably one set of serrated teeth 19. Preferably, the movable arm 15 is adapted for extending around the female end of the first threaded pipe 21 so that the gripping assembly can come in contact with the first threaded pipe. Preferably, the gripping assembly is one or more sets of teeth positioned intermittently along the movable arm. More preferably, the gripping assembly is a set of serrated teeth 19 which is positioned on the movable arm at a point approximately opposite to the stationary arm 16 and the hinge connection.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A device for effecting relative rotation between two threaded pipes about an axis of said pipes, comprising;

a central shank having two opposite ends, and being adapted at one end for connection to a top head drive of a drilling machine and at the other end for connection to an opposite end of a first of said threaded pipes;

a movable arm, being adapted to extend about said shank, and being connected to said shank via a hinge connection;

a stationary arm projecting from said shank is hinged to said movable arm via said hinge connection: and a gripping assembly being attached to said arm and being adapted to contact said first threaded pipe.

2. A device according to claim 1, wherein said shank has an upper and a lower portion; said lower portion having a male threaded end suitable for close connection to a female end of said first threaded pipe.

3. A device according to claim 2, wherein said hinge connection allows for relative swinging movement of said movable arm about said shank.

4. A device according to claim 3, wherein said upper portion of said shank is adapted at one end for connection using a removable locking pin to said top head drive.

5. A device according to claim 4, wherein said device is capable of being used for making or breaking drill rods.

6. A device according to claim 1, wherein said movable arm extends about but does not itself contact said shank; said movable arm being adapted to alternately swing away from and toward said shank.

7. A device according to claim 6, wherein said gripping assembly is positioned on said movable arm at a point opposite to said hinge connection.

8. A device according to claim 5, wherein said movable arm is adapted for extending around said female end of said first threaded pipe in order that said gripping assembly is capable of contacting said first tireaded pipe.

9. A device according to claim 6, further comprising a spring member with one end on said stationary arm and the other end on said movable arm.

10. A device according to claim 6, wherein said gripping assembly comprises one or more sets of teeth positioned intermittently along said movable arm.

11. A device according to claim 9, wherein said gripping assembly is a set of serrated teeth which is positioned on said movable arm at a point approximately opposite to said stationary arm and said hinge connection.

12. A device according to claim 11, wherein said spring member is tautly connected at one end to said movable arm in proximity to said set of serrated teeth, and at the other end to said stationary arm.

* * * * *